United States Patent [19]

Collura et al.

[11] 4,289,491

[45] Sep. 15, 1981

[54] APPARATUS FOR ADHESIVELY BONDING A CARTON

[75] Inventors: Peter C. Collura; Thomas R. Baker, both of Los Altos, Calif.

[73] Assignee: Kliklok Corporation, Greenwich, Conn.

[21] Appl. No.: 51,854

[22] Filed: Jun. 25, 1979

[51] Int. Cl.[3] ..... B31B 3/60

[52] U.S. Cl. ..... 493/124; 493/132; 493/143; 493/169; 493/336

[58] Field of Search ..... 93/51 R, 36 MM, 36.3, 93/56 PD, 53 SD, 47, 51 M, 51 HW; 493/124, 132, 143, 167, 169, 336

[56] References Cited

U.S. PATENT DOCUMENTS

| | | | |
|---|---|---|---|
| 1,098,386 | 6/1914 | Inman | 93/51 R |
| 1,144,772 | 6/1915 | Molins | 93/51 R |
| 1,965,274 | 7/1934 | Zanetti | 93/51 R |
| 3,008,386 | 11/1961 | Mosse | 93/51 R |
| 3,626,819 | 12/1971 | Hoyrup | 93/51 R |
| 3,638,537 | 2/1972 | Cato | 93/51 R |
| 3,657,975 | 4/1972 | Feldkamper et al. | 93/36 MM X |
| 3,854,385 | 12/1974 | Wallin | 93/56 PD X |

*Primary Examiner*—James F. Coan

*Attorney, Agent, or Firm*—Lowe, King, Price & Becker

[57] ABSTRACT

Apparatus for adhesively bonding a clam-shell type carton formed from a paperboard blank includes a carton forming die for receiving the paperboard blank, a movable frame for transferring the carton blank from a stack into registration over the die and a reciprocating plunger mounted above the die for forcing the carton blank into the die to fold and erect the carton. The movable frame includes a number of vacuum assisted suction cups for lifting the carton blank from the stack and a plurality of spring-loaded adhesive applicators, connected to a pressurized source of adhesive, for applying a spot of adhesive to selected portions of the carton blank when the blank, carried by the movable frame, is pressed into registration over the forming die. A stacking cage is disposed beneath the carton forming die to receive and retain the erected and folded cartons in a vertically stacked, nested arrangement, with adjacent cartons bearing against one another so that the adhesive coated portions of each nested carton are retained in contact with adjacent panels of the carton for a time sufficient to allow an adhesive bond to form therebetween.

14 Claims, 11 Drawing Figures

Fig. 1
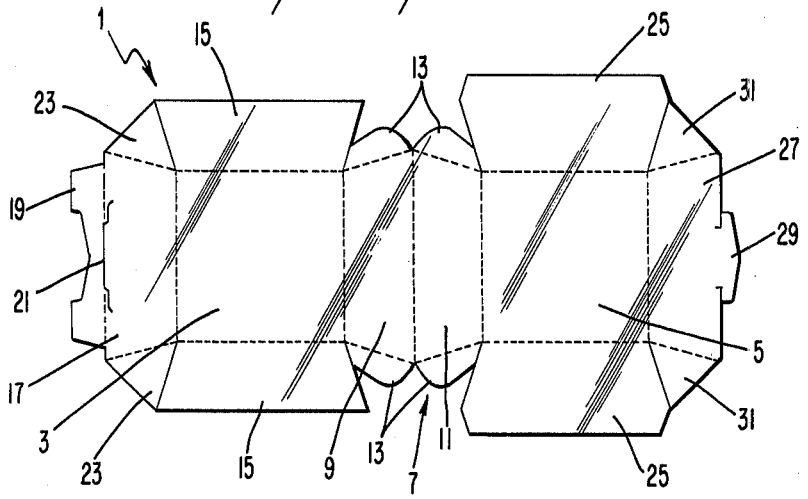
Fig. 2
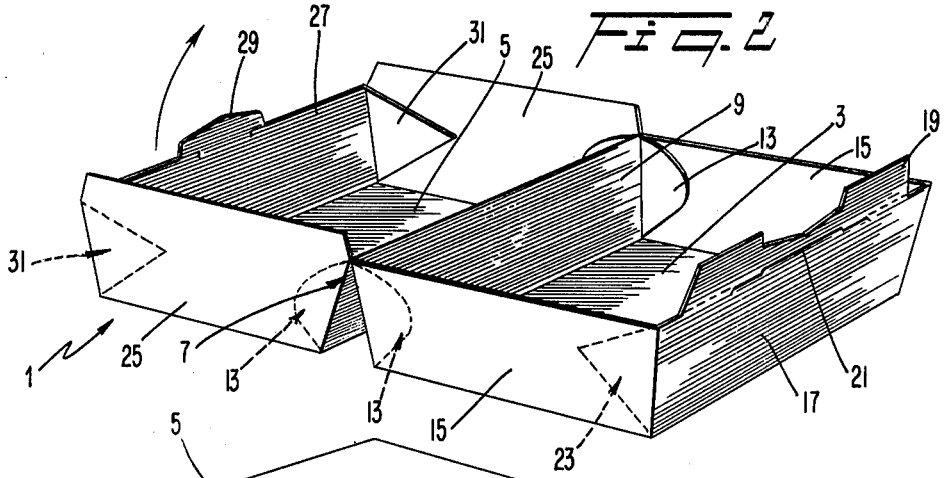
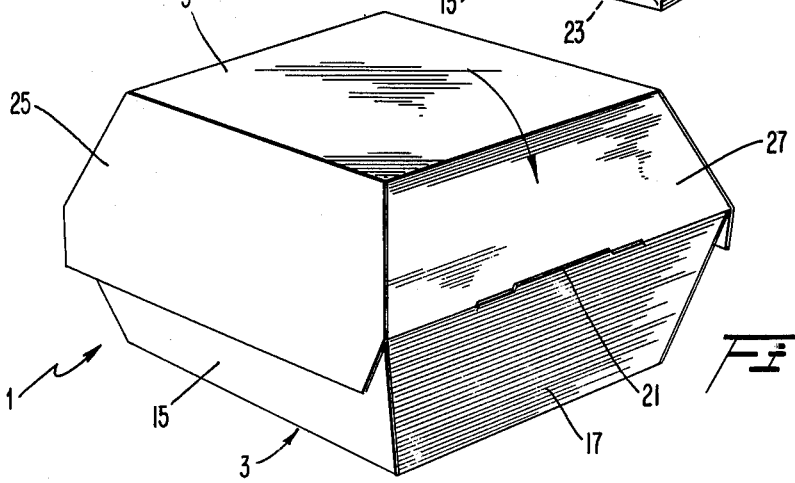
Fig. 3

37
35
45
35
43
33
33
35
45
35
1
45
1
91
89
69
39
49
49
41
49
49
1

Fig. 10
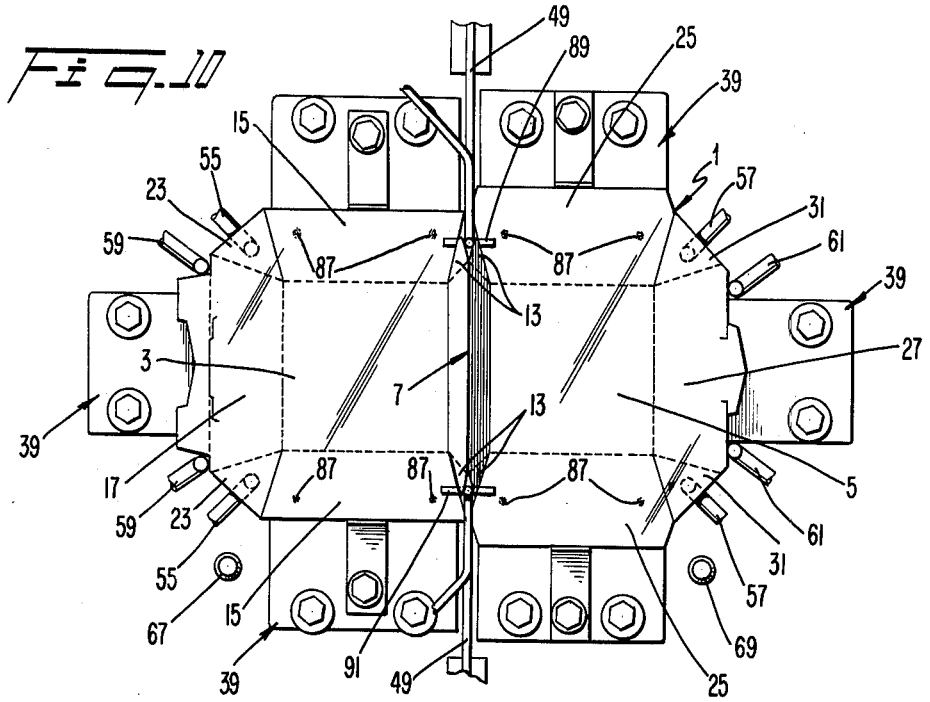
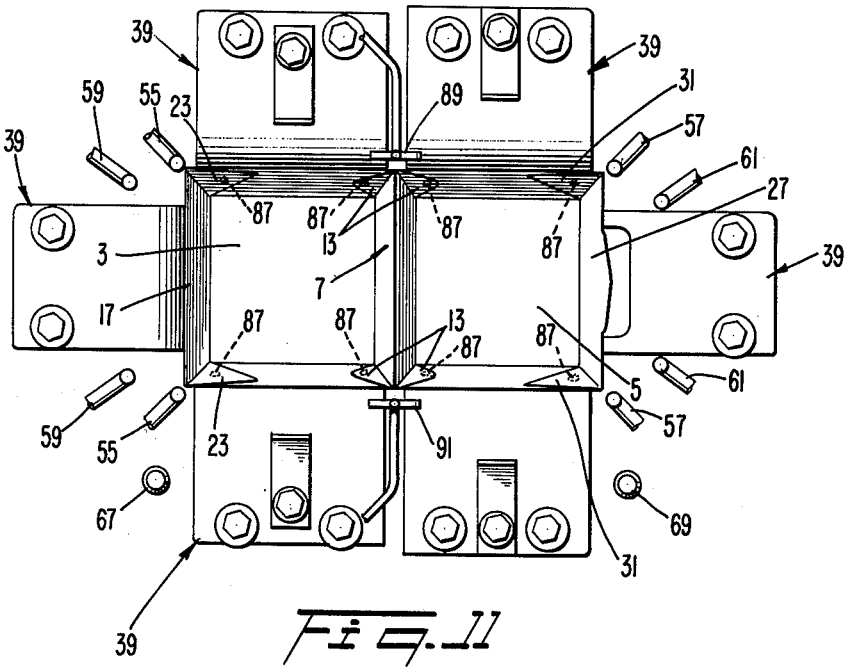
Fig. 11

APPARATUS FOR ADHESIVELY BONDING A CARTON

BACKGROUND OF THE INVENTION

The invention relates to the field of carton forming, and more particularly to apparatus for forming and adhesively bonding a carton formed from a coated paperboard blank.

Many types of cartons formed from folded paperboard or the like have been developed over the years. These cartons fall into two major groups, namely cartons which use interlocking corners and tabs to secure the carton in the erected position, and cartons which have an adhesive coating applied to selected portions of the paperboard blank. The latter cartons when erected, are secured in their erected position by the adhesive bond which forms between the panels.

Carton blanks which are to be adhesively bonded generally include at least a base panel, wall panels attached to the base panel, and gussets or panels formed at the corners of the wall panels. Adhesive is coated on the corner panels, or alternatively on portions of the wall panels adjacent the corner panels, and the carton walls and corner panels erected and folded into contact with one another and secured together for a time sufficient to allow the adhesive to set.

Prior art machines for performing such carton forming and gluing operations are exemplified by the patent to Hoyrup, U.S. Pat. No. 3,626,819 issued on Dec. 14, 1971 and assigned to the assignee of the present invention. This patent shows a vertically reciprocating plunger disposed above a carton forming die. A movable carrier having a suction cup transfers the carton blank from a stack into contacting registration with the upper surface of the carton forming die. The die includes a number of vertical posts for controllably erecting and folding wall panels of a carton blank disposed over the die when the carton blank is forced therein by the motion of the plunger. Spots or strips of adhesive are applied to the under surface of the blank at the die mouth by a daubing applicator which rises from a pool of adhesive disposed next to the die. One disadvantage of this prior art type of apparatus is that when a number of spots of adhesive must be applied to a carton blank, such as a clam-shell type blank, the large number of adhesive applicators and associated mechanisms which would be required would interfere with the carton folding process. Also, the daubers are known to have to be cleaned frequently and this adds to the overall costs of the packaging operation.

An alternative method of coating portions of a carton blank with adhesive involves the use of a spring-biased ball dispenser attached to a pivoting arm mounted adjacent the forming head, as shown in the patent to Zanetti, U.S. Pat. No. 1,965,274, issued on June 2, 1917. Adhesive applicators have also been placed on a separate glueing frame which swings across the carton blank before die forming, as shown in U.S. Pat. Application Ser. No. 3,854,385, issued on Nov. 14, 1961.

Finally, the patent to Mosse, U.S. Pat. No. 3,008,386, shows a moving carrier for transferring a carton blank from a stack into registration over a carton forming die in which the carrier includes a resistance heater for activating a thermoplastic adhesive coating applied to portions of the blank.

In order to increase the "throughput", or number of cartons which can be formed and glued within a given amount of time, it would be desirable to provide carton forming apparatus of the type described with some means for accurately and economically applying adhesive to a carton blank which would not interfere in any way with the carton forming apparatus itself. It is desirable to have such adhesive application means light in weight and relatively simple and inexpensive to construct and maintain. It is also desirable that such adhesive application means include some means to prevent application of adhesive when a carton blank is not registered over the mouth of the carton forming die.

It is therefore an object of the invention to provide apparatus for rapidly forming an adhesive bonded carton having improved adhesive application means.

It is another object to provide apparatus for rapidly forming an adhesive bonded carton having adhesive application means attached directly to the carton blank transfer frame.

It is a further object to provide apparatus for rapidly forming an adhesive bonded carton having means for securing the adhesively bonded joints of a carton after forming.

It is yet a further object to provide apparatus for rapidly forming an adhesive bonded carton including means for preventing actuation of the adhesive applicator means when no carton blank is attached to the carton blank transfer frame.

These and other objects are achieved by the present invention wherein there is provided improved apparatus for adhesively bonding a carton. The paperboard clam-shell blank from which the carton is formed includes at least a base panel, wall panels attached to the base panel, and corner panels formed at the corners of the wall panels. The apparatus includes a carton forming die for receiving a paperboard blank, a reciprocating plunger mounted above the die for forcing the carton blank into the die to erect and form the carton, a movable frame having one or more vacuum assisted suction cups mounted thereto for lifting a carton blank from a stack, and means for moving the frame to transfer the carton blank held by the suction cups from the stack into registration over the forming die and for pressing the carton blank into contact with the die. The adhesive applying means includes one or more spring-loaded adhesive applicators connected to a pressurized source of liquid adhesive for applying adhesive to a selected portion of the carton blank when the carton blank is pressed into contacting registration with the die. A stacking cage disposed beneath the carton forming die receives and retains the erected and formed carton in a vertically stacked, nested arrangement, whereby the adhesive coated corners of the carton are retained in contact with adjacent carton wall panels by the pressure applied from the previous nested carton, for a time sufficient to allow an adhesive bond to form therebetween.

The spring-loaded adhesive applicator of the invention, includes a hollow cylindrical feed tube connected to a source of pressurized liquid adhesive, a constricted opening formed in the feed tube, and a spring-biased ball valve disposed in the constricted feed tube opening. When the carton blank, carried by the movable frame, is pressed into contacting registration with the forming die, the spring biased ball valve is displaced by contact with the carton blank and pressurized adhesive flows therethrough onto the carton blank. Openings formed on the surface of the die cooperate with the adhesive applicators when no carton blank is secured to the movable transfer frame. As will be understood more fully below, the carton blank forms a bridge over the openings in order to lift the ball in the valve off the seat thereby providing the desired controlled spot of adhesive.

The adhesive applicators of the present invention are small in size and light in weight, permitting a number of such applicators to be mounted on the carton blank transfer frame without unduly burdening the frame with excessive weight that would otherwise limit speed. These small size applicators can be used in the limited space available on the transfer frames in modern carton folding apparatus with a minimum amount of modification.

The spring-loaded applicators are self-opening when contacting the carton, thus eliminating the need for complex and heavy solenoid or air-actuated adhesive valves. The adhesive applicators accurately dispense the proper amount of liquid adhesive to selected areas of the carton blank with little or no wastage or spilling of adhesive.

The adhesively coated carton is rapidly set up by the reciprocating plunger of the apparatus of the present invention which forces the carton through the die to erect the carton walls and fold the corner panels of the carton into contact with adhesive coated portions of adjacent carton walls. When the reciprocating plunger reaches its lowest point of harmonic motion with respect to the forming die, the erected carton is ejected from the lower portion of the forming die into a stacking cage which retains the cartons in a stacked arrangement. The cartons are nested one above the other to secure the adhesive coated portions of the wall panels against the corner panels for a time sufficient to allow an adhesive bond to form therebetween. Since the adhesive sets while the erected carton is securely retained in the stacking cage by the pressure applied from neighboring nested cartons, the throughput of the carton forming apparatus is independent of the adhesive setting time. Thus, the number of cartons which can be set up and bonded within a given period of time depends mainly on how quickly a carton blank can be fed into the registration with the die and then forced therethrough by the reciprocating plunger.

BRIEF DESCRIPTION OF THE DRAWING FIGURES

These and other objects and features of the present invention are presented in the following detailed description taken in conjunction with the accompanying drawing figures, wherein:

FIG. 1 is a plan view of a preferred type of clam-shell carton blank for use with the apparatus of the present invention;

FIG. 2 is a perspective view of the carton blank of FIG. 1 showing it in its folded and erected position;

FIG. 3 is a perspective view of the carton of FIG. 2 showing it in its final, assembled and closed position;

FIG. 10 is a top view of the carton forming die shown in FIG. 4, illustrating the arrangement of the die, corner panel folding posts, and carton blank in its initial position; and FIG. 11 shows the carton blank of FIG. 10 as it is being progressively folded and erected in the carton forming die.

DESCRIPTION OF THE PREFERRED EMBODIMENT

Figure 4:
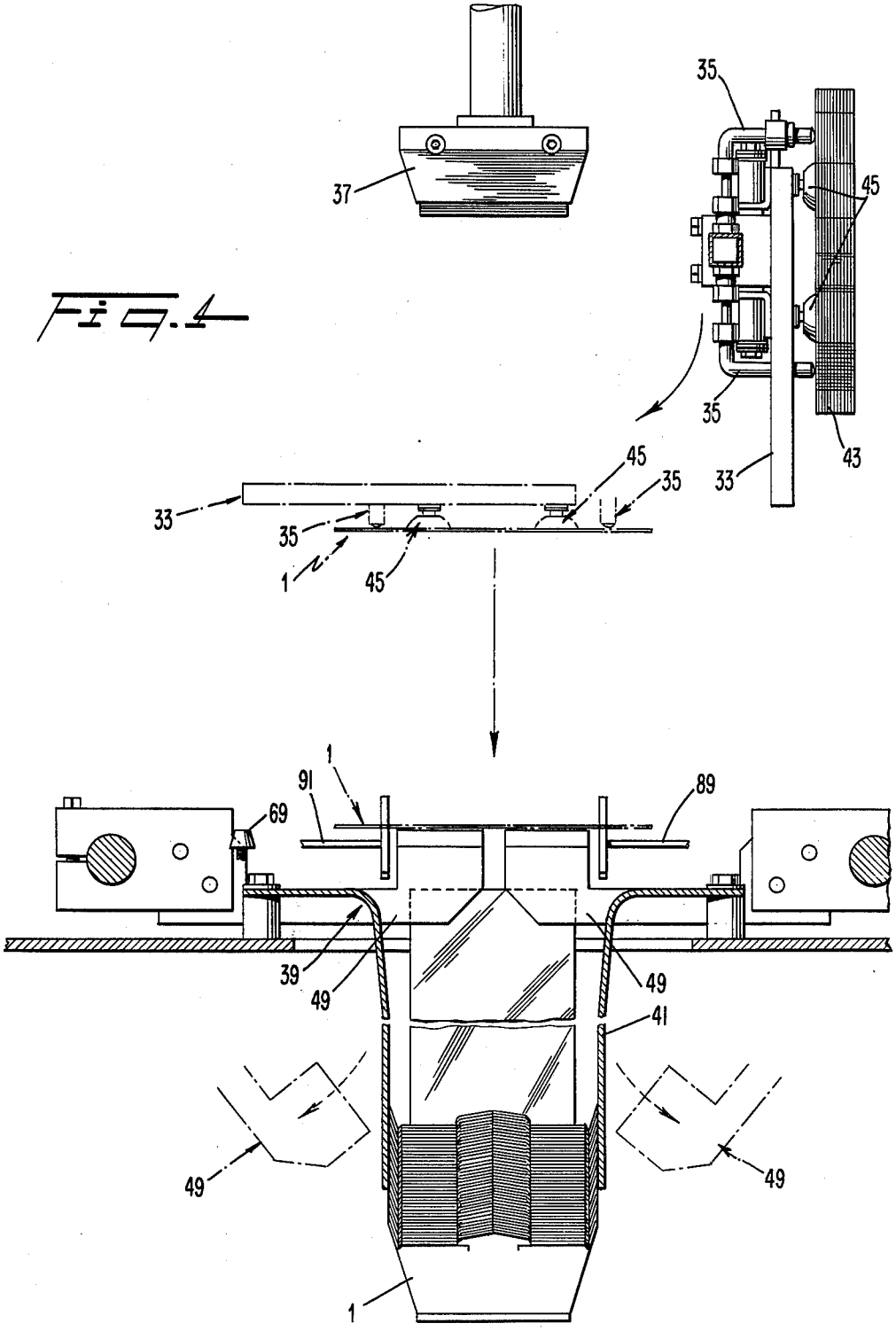
FIG. 4 is a right side cross-sectional view of a preferred apparatus for forming the carton of FIGS. 1 through 3.
Figure 5:
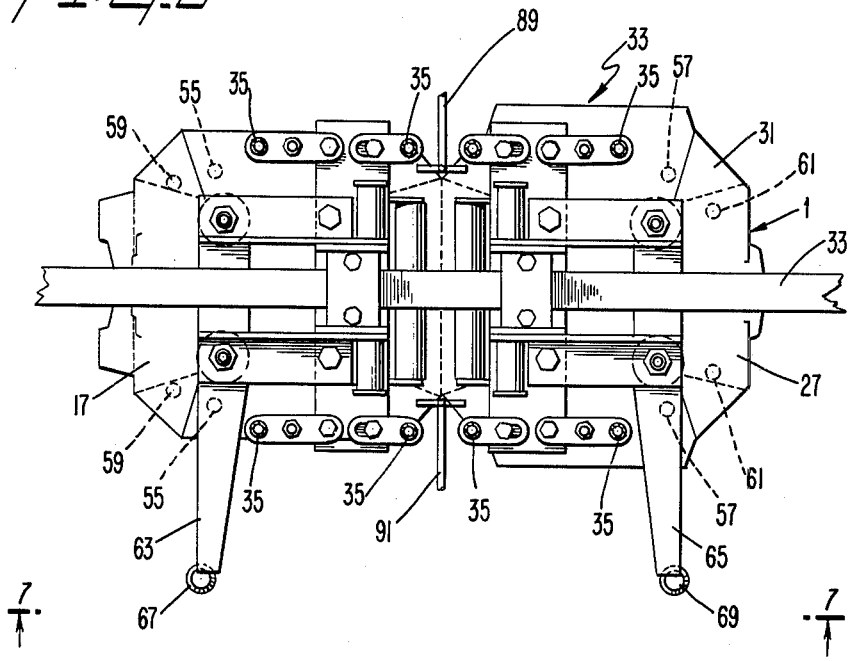
FIG. 5 is a top view of a carton blank transfer frame shown in its unactuated position holding a carton blank.
Figure 6:
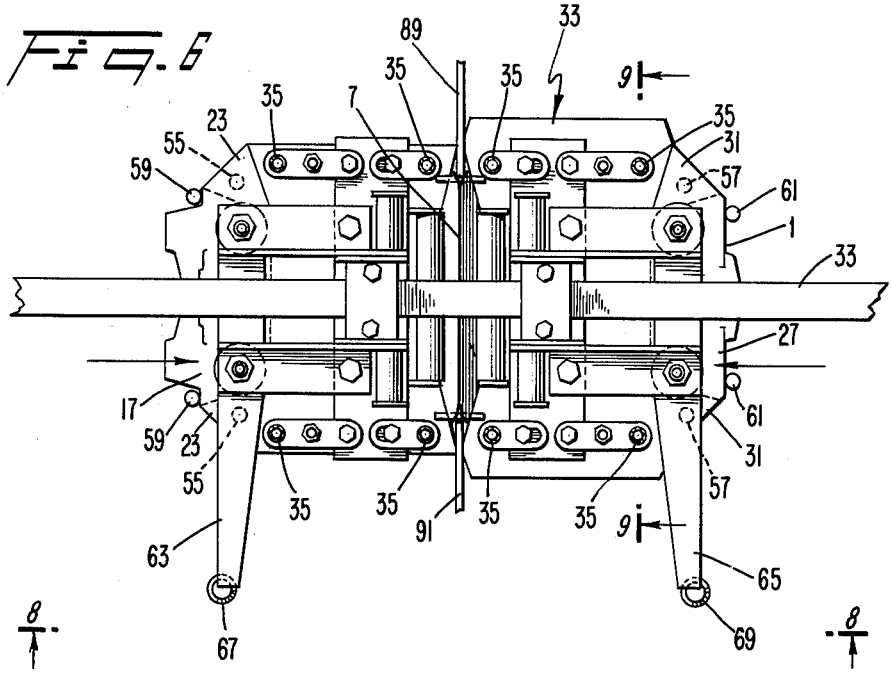
FIG. 6 shows the carton blank transfer frame of FIG. 5 in its actuated position for initiating the folding of the articulated hinge of the clam-shell carton of FIG. 1.

A preferred form of a carton blank for use with the apparatus of the present invention is shown in FIG. 1 and includes a lefthand base panel 3, and a righthand base panel 5 connected to base panel 3 by a "living" (articulated) hinge 7. Hinge 7 is formed by lefthand hinge panel 9 and righthand hinge panel 11, which are respectively connected to base panels 3 and 5. Hinge panels 9 and 11 each include a pair of tabs 13 formed on opposite ends thereof. A pair of side wall panels 15 are attached to opposite sides of base panel 3. An end wall panel 17 is also attached to the remaining side of base panel 3. A locking flap 19, including a locking slit 21, is formed on the outer portion of wall panel 17. A pair of folding corner panels 23 are formed between left side wall panels 15 and left end panels 17.

Similarly, a pair of wall panels 25 are attached to righthand base panel 5. A righthand end panel 27 is also attached to the remaining side of righthand base panel 5 and includes a locking tongue 29 which is adapted to fit into locking slit 21 when the carton blank is erected as shown in FIG. 3. A pair of folding corner panels 31 are formed between righthand wall panels 25 and righthand end panel 27. Corner panels 23 and 31 are separated from their respective adjacent wall panels 15 and 25 by a cut or slit, shown in solid lines in FIG. 1. The dashed lines in FIG. 1 indicate prescored areas of the carton blank adapted to be folded.

It will be appreciated that a number of folding and gluing operations must be performed in order to form the paperboard blank of FIG. 1 into the completed, clam shell type carton shown in FIG. 2. The line between hinge panels 9 and 11 of hinge 7 must be properly prebroken and then folded, glue applied to areas of wall panels 15 and 25 adjacent tabs 13 and corner panels 23 and 31, and then the side and end walls of the carton folded and erected into the position shown in FIG. 2. Contact between tabs 13 and corner panels 23 and 31 and the bonded areas on the carton side walls must be maintained for a time sufficient to allow an adhesive bond to form therebetween. Because adhesive must be applied to at least eight areas of carton 1, it is desirable for the carton forming apparatus to include relatively simple means for precisely applying the adhesive to selected areas of the carton. Of primary importance is to insure that the operation does not substantially interfere with the speed of operation of the carton forming apparatus. To this end the carton forming apparatus of the present invention includes a paperboard blank carrier frame 33 to which is mounted a number of spring-loaded adhesive applicator assemblies 35 for applying a liquid adhesive under pressure to selected areas of the carton blanks as shown in FIG. 4 in conjunction with FIGS. 7–9, and will be described in detail below.

The carton forming apparatus shown in FIGS. 4 through 11 includes a vertically reciprocating plunger 37, a carton forming head or die assembly 39 disposed directly beneath plunger 37 for receiving a carton blank, such as shown in FIG. 1, and a stacking cage 41 disposed beneath die 39. The cage 41 comprises a number of vertically disposed rails for receiving and retaining the carton blanks after they are erected.

Carton blanks to be folded and erected are sequentially transferred from a stack of carton blanks 43 by means of one or more vacuum assisted suction cups 45 connected to the underside of carton blank carrier frame 33. A source of negative air pressure V (FIG. 7) is connected to suction cups 45 to pick up a carton blank from stack 43 (FIG. 4). Carton blank carrier frame 33 is mounted to a drive (not shown) for movement about an axis to transfer a single carton blank from stack 43, as shown by solid lines in FIG. 4, into registration directly over forming die assembly 39, as shown by broken lines in FIG. 4. Movable carton blank carrier frame 33 is then moved downwardly toward the upper face of die assembly 39.

Figure 7:
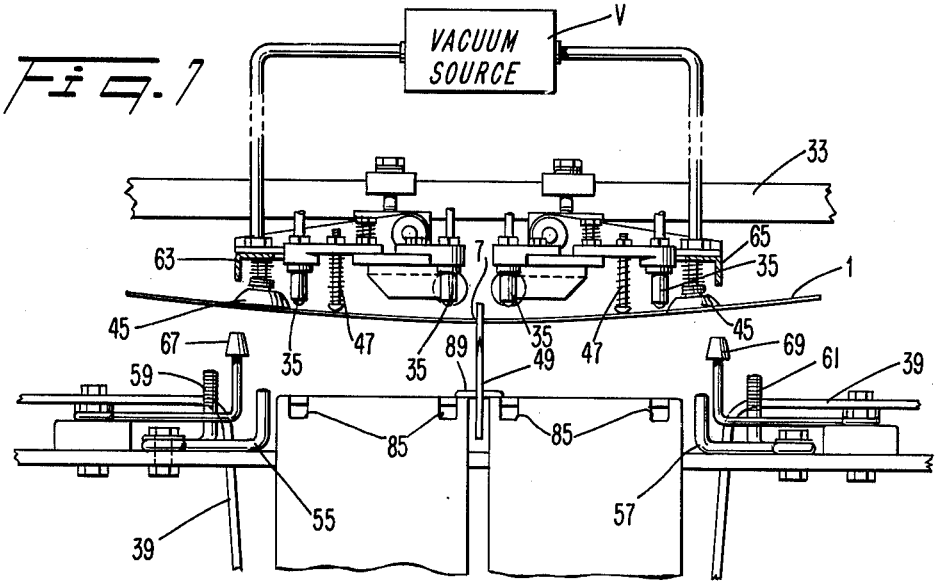
FIG. 7 is a cross sectional view of the transfer frame of FIG. 5 taken along lines 7—7.
Figure 8:
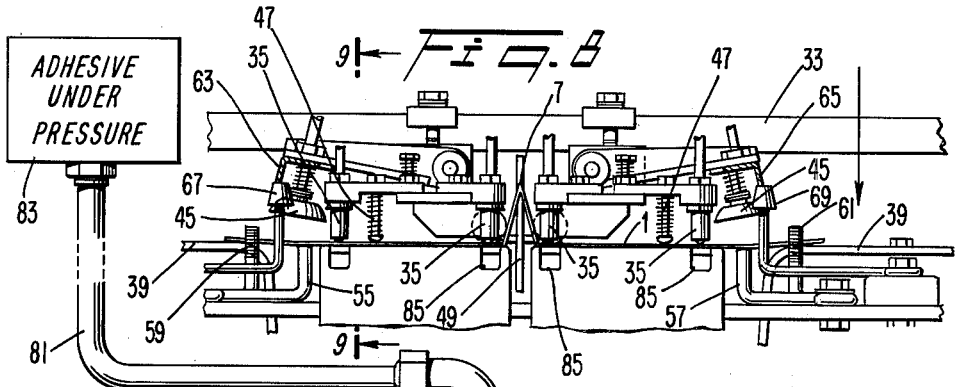
FIG. 8 is a cross sectional view of the carton blank transfer frame of FIG. 6 taken along lines 8—8.

As shown clearly in FIG. 7, the carton blank carrier frame 33 includes a number of spring-loaded control plungers 47 designed to prevent the surface of the carton blank from applying unwanted pressure to spring-loaded adhesive applicators 35 before the die 39 is engaged. Also, spring-loaded plungers 47 cause carton blank 1 to be held in a slightly bowed position with respect to frame 33. Plungers 47 prevent carton blank 1 from contacting the tips of adhesive applicators 35 until the carrier frame and carton blank are fully registered into contact with the upper surface of forming die 39, as shown in FIG. 8. As frame 33 approaches the upper surface of forming die assembly 39, a pair of hinge folding blades 49 are pivoted into the position shown by solid lines in FIG. 4. Openings are formed in the side walls of die assembly 39 to allow for the pivoting motion of blades 49.

Just prior to the point at which carton blank 1 is fully registered in contact with the surface of carton forming die 39 (FIG. 8), hinge 7 of carton blank 1 contacts the upper edge of hinge prebreaking blades 49. The continued downward motion of the frame carrier carton blank 1 causes hinge portion 7 of blank 1 to be folded into an inverted V-shape as shown in FIG. 8.

As carton blank 1 is pressed into contact with the upper surface of forming die 39, as shown in FIG. 8, corner panels 25 and 31 of carton blank 1 are urged upwardly through contact with respective left and right hand erecting posts 55 and 57. Hinge 7 of carton blank 1 is formed through the downward motion of transfer frame 33 which forces hinge area 7 against blades 49. As a result, the outer edges of end panels 17 and 27 of carton blank 1 are drawn into engagement with respective left and right hand carton registration posts 69 and 61. Registration posts 59 and 61 include threaded portions formed thereon which engage the outer edges of carton blank end panels 17 and 27 to prevent misalignment or dislocation of the carton blank after carrier frame 33 is removed from contact therewith.

Nearly simultaneously with the contacting engagement of carton blank 1 with the upper surface of forming die 39, respective left and right hand bumpers 67 and 69 causing the spring-loaded suction cups 45 carried on spring-biased pivoting activator arms 63 and 65, to be disengaged from contact with the surface of tray blank 1, as shown in FIG. 8. At this time the spring-loaded adhesive applicators 35 contact the surface of carton blank 1 and are activated.

Figure 9:
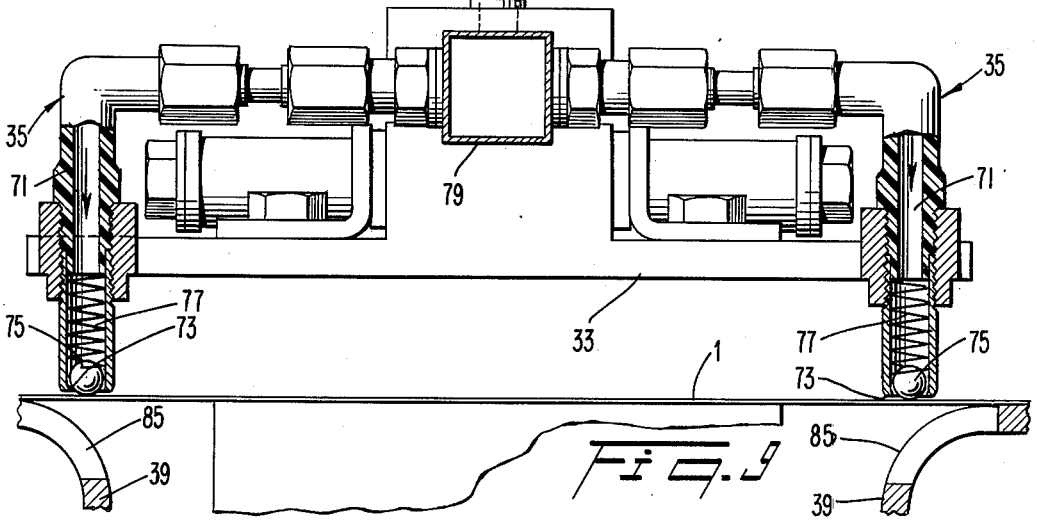
FIG. 9 is a detailed cross-sectional view of the spring-loaded adhesive applicators which are mounted to the carton blank carrier frame shown in FIG. 8 taken along lines 9—9.

As shown clearly in FIG. 9, each adhesive applicator 35 comprises a hollow cylindrical feed tube 71 having a constricted opening or seat 73 formed at one end thereof. Each adhesive applicator 35 further includes a ball valve comprising a circular ball 75 biased by a spring 77 on the seat 73 to keep the applicator normally closed. Feed tube 71 of adhesive applicator 35 is connected to a manifold 70 which in turn is connected through a hose 81 to source of adhesive 83. The adhesive contained in pressurized adhesive source 83 preferably is a liquid adhesive, such as polyvinyl acetate. Thus, the downward motion of adhesive applicators 35, attached to movable carrier frame 33, causes ball 75 of applicators 35 to contact the upper surface of carton blank 1 and displace ball 75 upwardly to open the ball valve. The adhesive under pressure flows through tube 71 and nozzle 73 of applicator 35 to apply the adhesive to a selected area of carton blank 1 (shown as spots 87 in FIG. 10) directly below each applicator 35.

As mentioned above, the apertures 85, disposed beneath each applicator 35, are formed in the upper surface of die 39 adjacent the mouth of the die. In the event that no carton blank 1 is secured to carrier frame 33, or if a carton blank is improperly registered on top of die 39, applicators 35 are received within apertures 85 to prevent the actuation of the adhesive applicator ball valve. Alternatively, an apertured backup plate can be placed directly over the upper surface of die 39 to serve the same purpose. In either case, accidental or unwanted actuation of adhesive applicators 35 is prevented without the need for complicated carton registration sensing apparatus, as is common in the prior art. This technique for preventing unwanted actuation of adhesive applicators 35 constitutes an important feature of the present invention.

After adhesive has been applied to carton blank 1, the motion of movable frame 33 is reversed, drawing the frame upwardly away from die 39. Ball valves of adhesive applicators 35 automatically close and the movable frame 33 is pivoted into position (as shown in solid lines in FIG. 4) to pick up and transfer the next carton blank in stack 43.

In FIG. 10, carton blank 1 is shown aligned in full contacting registration with the upper surface of die 39 and subsequent to the application of adhesive to selected areas 87 of the carton blank and removal of carrier frame 33. Side wall panels 15 and 25 of carton 1 are secured in a relatively horizontal position over die 39 by T-bar retaining devices 89 and 91.

Once the blank is in the operative position with adhesive applied, as just described, blades 49 are pivoted downwardly into a standby position, shown by dashed lines in FIG. 4. Reciprocating plunger 37 is then actuated to move downwardly into contact with the upper surface of carton blank 1 disposed over die 39. The downward motion of plunger 37 forces carton blank 1 into the mouth of die 39 with corner panels 23 and 31 being fully folded and erected through contact with posts 55 and 57. As carton blank 1 is further urged into die 39, side and end panels 15, 25, 17 and 27 are erected. When carton 1 is fully erected, carton panels 23 and 31 and hinge tabs 13 are disposed adjacent to and in contact with the previously applied spots of adhesive 87 as shown in FIG. 11 (with plunger 37 removed for clarity).

When plunger 37 reaches its lowest point of reciprocating harmonic motion with respect to die 39, the erected carton is ejected into a stacking cage 41, as shown in FIG. 4. Stacking cage 41 comprises a number of vertically disposed guide rails. Stacking cage 41 receives and retains the erected cartons in a nested fashion, one within the other. The exterior of a nested carton is in intimate contact with the interior of its next lower carton. This arrangement causes corner panels 23, 31 and tabs 13 to be securely held against glued areas 87 of wall panels 15 and 25 while the adhesive sets. Thus, the nested stacked arrangement of cartons 1 in stacking cage 41 allows the glued joints of carton 1 to be secured for a time sufficient to allow the adhesive to set without hindering the operating speed of the reciprocating plunger and carrier frame assembly. An important advantage of this arrangement is that the "throughput" or number of cartons which can be formed in a given amount of time by the present invention is independent of the adhesive setting time. In addition, no auxiliary apparatus is needed to clamp or hold the glued joints of the cartons since the stacking cage performs this function.

Cartons 1 are reasily removed from the bottom of stacking cage 41 one by one or as needed.

It can thus be seen that the present invention has many advantages over prior art adhesive bonding apparatus for cartons. The adhesive applicators of the present invention are small in size and light in weight which allow their use directly on a movable carton blank carrier frame. The small size of the adhesive applicators allows their use within the confined areas present on modern day carton forming apparatus. The spring-loaded ball valve of the adhesive applicators enables a precise quantity of liquid adhesive to be applied to selected areas of a carton blank without wastage or spillage of the adhesive.

The adhesive applicators of the present invention are useful for applying adhesive to a wide variety of paperboard blanks. Any number of the adhesive applicators can be arranged about a carton blank carrier frame to accommodate different size cartons or particular gluing needs. The apertures formed around the periphery of the forming die advantageously prevent accidental or unwanted actuation of the adhesive applicators in the event that a carton blank has not been picked up by carrier 33 or if the carton blank is misregistered over the forming die. The nested stacking arrangement of the cartons in the stacking cage of the present invention allows the glued joints of the formed and erected carton to be securely held by the pressure of adjacent cartons for a time sufficient to allow the glued joints to set, thus dispensing with the need for auxiliary clamping apparatus which might interfere with the carton folding process.

While the adhesive bonding apparatus of the present invention has been described in considerable detail, it is understood that various changes and modifications may occur to persons of ordinary skill in the art without departing from the spirit and scope of the appended claims.

What is claimed is:

1. A carton blank feeding means for delivering a blank to a forming die comprising:

a movable frame;

at least one vacuum assisted suction cup mounted to said frame for lifting a carton blank from a stack;

means for moving said frame to transfer said carton blank carried by said suction cup from said stack into registration over said forming die and for pressing said carton blank into contact with said die, and at least one adhesive applicator, connected to a pressurized source of liquid adhesive, for applying a spot of said adhesive to a selected portion of said carton blank while held on said movable frame and when said carton blank is pressed into contact with said die.

2. The apparatus of claim 1 wherein said adhesive applicator is spring-loaded and includes:

a hollow cylindrical feed tube connected to said source of pressurized adhesive;

a constricted opening formed in said feed tube; and a spring-biased ball valve disposed within said constricted feed tube opening, whereby when said carton blank carried by said movable frame is pressed into contacting registration with said forming die, said spring-biased ball valve is displaced by contact with said carton blank to allow a flow of pressurized liquid adhesive therethrough onto said carton blank.

3. The apparatus of claim 2 including means for preventing the actuation of said adhesive applicator when no carton blank is secured to said movable frame.

4. The apparatus of claim 3 wherein said means for preventing actuation of said adhesive applicator when no carton blank is secured to said movable frame comprises at least one aperture formed on an upper portion of said forming die, each said aperture disposed beneath each side adhesive applicator when said movable frame is in registration over said die, each said aperture dimensioned larger than said applicator to receive said applicator therein to prevent actuation of said ball valve.

5. The apparatus of claim 1 wherein said liquid adhesive is polyvinyl acetate.

6. The apparatus of claim 2 wherein said carton blank feeding means further includes means for releasing said vacuum assisted carton blank transfer means when said carton blank is pressed into contact with said forming die.

7. Improved apparatus for adhesively bonding a carton formed from a paperboard blank or the like, the carton including at least a base panel, wall panels attached to the base panel, and corner panels formed at the corners of the wall panels, the apparatus including a carton-forming die for receiving the paperboard blank and a reciprocating plunger mounted above the die for forcing the carton blank into the die to fold and erect the carton, the improvement comprising:

means for sequentially feeding a carton blank from a stack into registration over said carton forming die said feeding means including:

vacuum assisted carton blank transfer means; and at least one adhesive applicator means, mounted on said transfer means and connected to a pressurized source of adhesive, for applying adhesive to a selected portion of said carton blank while held on said feeding means and when said carton blank is placed in registration and pressed into contact with said die;

means disposed beneath said carton forming die, for receiving and retaining said errected and folded carton in a vertically stacked arrangement, a plurality of said cartons being nested within one another, whereby said adhesive coated portions of said carton are retained in contact with adjacent wall panels for a time sufficient to allow an adhesive bond to form therebetween.

8. The apparatus of claim 7 wherein said carton receiving and retaining means comprises a plurality of vertically disposed, spaced-apart guide rails.

9. The apparatus of claim 1 wherein the adhesive in said pressurized source is polyvinyl acetate.

10. Improved apparatus for adhesively bonding a carton formed from a paperboard blank or the like, the carton including at least a base panel, wall panels attached to the base panel, and corners panel formed on the corners of the wall panels, the apparatus including a carton forming die for receiving the paperboard blank and reciprocating plunger mounted above the die for forcing the carton blank into the die to fold and erect the carton, the improvement comprising:

a movable frame;

at least one vacuum assisted suction cup mounted to said frame for lifting a carton blank from a stack;

means for moving said frame to transfer said carton blank held by said suction cup from said stack into registration over said forming die and for pressing said carton blank into contact with said die;

at least one spring-loaded adhesive applicator, connected to a pressurized source of liquid adhesive, for applying said adhesive to a selected portion of said carton blank while held substantially without relative lateral movement and when pressed into contacting registration with said die; and a stacking cage disposed beneath said carton forming die for receiving and retaining said erected and folded carton in a vertically stacked arrangement, a plurality of said cartons being nested within one another, whereby said adhesive coated portions of said carton are retained in contact with adjacent wall panels for a time sufficient to allow an adhesive bond to form therebetween.

11. The apparatus of claim 10 wherein said spring-loaded adhesive applicator includes:

a hollow cylindrical feed tube connected to said source of pressurized liquid adhesive;

a seat formed in said feed tube; and spring-biased ball valve disposed within said seat whereby when said carton blank carried by said movable frame is pressed into contacting registration with said forming die, said spring-biased ball valve is displaced by contact with said carton blank to allow a flow of pressurized adhesive therethrough onto said carton blank.

12. The apparatus of claim 1 including means for preventing the actuation of said adhesive applicator when no carton blank is secured to said movable frame, comprising at least one aperture formed on an upper portion of said forming die, each said aperture disposed beneath each adhesive applicator when said movable frame is in registration over said die, each said aperture dimensioned larger than said applicator to receive said applicator therein to prevent actuation of said ball valve.

13. The apparatus of claim 10 including means for releasing said vacuum assisted suction cup from said carton blank when said carton blank is pressed into contacting registration with said forming die.

14. The apparatus of claim 10 wherein said stacking cage comprises a plurality of vertically disposed, spaced-apart guide rails.

* * * * *